US006989802B2

(12) United States Patent
Mizobata

(10) Patent No.: US 6,989,802 B2
(45) Date of Patent: Jan. 24, 2006

(54) DRIVING METHOD FOR AC-TYPE PLASMA DISPLAY PANEL

(75) Inventor: Eishi Mizobata, Tokyo (JP)

(73) Assignee: Pioneer Corporation, Tokyo (JP)

( * ) Notice: Subject to any disclaimer, the term of this patent is extended or adjusted under 35 U.S.C. 154(b) by 522 days.

(21) Appl. No.: 10/300,889

(22) Filed: Nov. 21, 2002

(65) Prior Publication Data

US 2003/0095084 A1 May 22, 2003

(30) Foreign Application Priority Data

Nov. 22, 2001 (JP) ..... 2001-356997

(51) Int. Cl.
*G09G 3/28* (2006.01)

(52) U.S. Cl. ..... 345/60; 315/169.4

(58) Field of Classification Search ..... 345/60–63, 345/66, 68, 74.1, 76, 208; 315/160–176, 315/450–550

See application file for complete search history.

(56) References Cited

U.S. PATENT DOCUMENTS 5,661,500 A 8/1997 Shinoda et al.

6,734,844 B2 * 5/2004 Mizobata ..... 345/208

FOREIGN PATENT DOCUMENTS

JP 12-206933 7/2000

OTHER PUBLICATIONS

H. Hirakawa et al., "19.2: Cell Structure and Driving Method of a 25–in. (64–cm) Diagonal High–Resolution Color ac Plasma Display", Society for Information Display, 98, Digest, (May 1998), pp. 279–281 with Abstract.

* cited by examiner

*Primary Examiner*—Bipin Shalwala
*Assistant Examiner*—Mansour M. Said

(57) ABSTRACT

In a priming erasing period, a voltage Vpe1 is applied to a common electrode, and after an electric potential of a scanning electrode is discontinuously lowered to a positive electric potential lower than the voltage Vpe1, the electric potential is continuously lowered to a voltage Vpe2. In this case, an electric potential difference between the voltage Vpe1 and the voltage Vpe2 is set equal to a firing voltage. Also, an electric potential of the scanning electrode at an end of the priming erasing period is set higher than an electric potential of a data electrode by approximately 20 V. With this operation, there is provide an AC-type plasma display panel having an extended driving margin (range) of a sustaining voltage and capable of being driven by a low voltage.

11 Claims, 10 Drawing Sheets

DRIVING METHOD FOR AC-TYPE PLASMA DISPLAY PANEL

BACKGROUND OF THE INVENTION

1. Field of the Invention

The present invention relates to a driving method for an AC (Alternating Current) type plasma display panel having a large range of a sustaining voltage and capable of being driven by a low voltage.

The present application claims priority of Japanese Patent Application No. 2001-356997 filed on Nov. 22, 2001, which is hereby incorporated by reference.

2. Description of Related Art

Generally, a plasma display panel (PDP) has many characteristics, for example, the PDP is thin and can perform large screen display easily, an angle of visibility is wide, and a response speed is fast. Therefore, the PDP is recently used as a flat panel display such as a wall-mounted television or a public display panel and a like. Based on driving methods, PDPs are divided into two types including a direct current type discharge PDP (a DC-type PDP) driven by exposing electrodes to a discharge space filled with a discharge gas so as to generate a direct current discharge between the electrodes and an alternating current type discharge PDP (an AC-type PDP) driven in a state of an alternating current discharge without directly exposing electrodes to the discharge gas by coating a dielectric layer on the electrodes. In the DC-type PDP, the discharge continues when a voltage is applied, and in the AC-type PDP, the discharge continues by reversing a polarity of the voltage. Also, AC-type PDPs are divided into two types including one having two electrodes in one picture cell and the other having three electrodes in one picture cell. The PDPs having these structures are described in a document, for example, in "Society for Information Display '98 Digest, pp. 279–281, May, 1998".

Next, explanations will be given of a structure and a driving method of a conventional three-electrode AC-type PDP. FIG. 7 is a sectional view showing a cell structure of the conventional three-electrode AC-type PDP. FIG. 8 is a plan view showing an electrode arrangement of the conventional three-electrode AC-type PDP.

As shown in FIG. 7, the conventional three-electrode AC-type PDP is provided with a front substrate 20, and a rear substrate 21 opposite to the front substrate 20. The front substrate 20 and the rear substrate 21 are made of glass or a like. A plurality of scanning electrodes 22 and a plurality of common electrodes 23 are alternately arranged in parallel at a predetermined intervals on a surface opposite to the rear substrate 21 in the front substrate 20. The scanning electrodes 22 and the common electrodes 23 are transparent electrodes made of ITO (Indium Tin Oxide) or a like, and extend from the back to the front in FIG. 7.

Metal electrode 32 is laminated on each of the scanning electrode 22 and the common electrode 23 to reduce wring resistance. Also, a transparent dielectric layer 24 is provided to cover the scanning electrode 22 and the common electrode 23, and a protection layer 25 made of MgO or a like is formed on the transparent dielectric layer 24.

A plurality of data electrodes 29 are provided on a surface opposite to the front substrate 20 in the rear substrate 21. Each of the data electrodes 29 extends in a direction orthogonal to the scanning electrodes 22 and the common electrodes 23 (in a longitudinal direction in FIG. 7). A white dielectric layer 28 and a fluorescent layer 27 are provided on the data electrodes 29.

A partition (not shown) is provided between the front substrate 20 and the rear substrate 21. The partition is provided in a grid array viewed from a direction orthogonal to a surface of the front substrate 20 and divides a discharge space 26 into picture cells (display cells). In each picture cell 31 (shown in FIG. 8), each scanning electrode 22, each common electrode 23 and each data electrode 29 are introduced, and a closest point to the scanning electrode 22 in the data electrode 29 and a closest portion to the common electrode 23 in the data electrode 29 are included. In the discharge space 26, a mixed gas such as He, Ne, and Xe is filled as a discharge gas.

As shown in FIG. 8, in a display screen 30 of the PDP, picture cells 31 are arranged in a matrix so as to include respective closest portions of the scanning electrodes 22 (Si (i equals 1 to m)) and the common electrodes 23 (Ci (i equals 1 to m)) to the data electrodes 29 (Dj (j equals 1 to n)). A discharge gap 37 for generating surface discharge is arranged between the scanning electrode Si and the common electrode Ci, and a non-discharge gap 38 for generating no surface discharge is arranged between the scanning electrode Si and the common electrode Ci–1.

Next, a driving method for the conventional three-electrode AC-type PDP will be explained. Conventionally, a main three-electrode AC-type PDP driving method is a scanning-displaying separation (ADS technique). The driving method of the scanning-displaying technique will be explained. FIG. 9 is a waveform view showing the conventional three-electrode AC-type PDP driving method. FIG. 10A to FIG. 10E are sectional schematic views showing the conventional PDP driving method. In FIG. 10A to FIG. 10E, positive wall charges 35 and negative wall charges 36 are represented by various polygonal figures, and heights of the positive wall charges 35 and the negative wall charges 36 represent levels of wall voltages caused in dielectric layers by wall charges.

As shown in FIG. 9, in the three-electrode AC-type PDP driving method, a field includes a plurality of sub-fields, and one sub-field 8 includes three periods, namely, a primary discharge period 7, a scanning period 5 and a sustaining period 6.

First, the primary discharge period 7 will be explained. At a start point of the primary discharge period 7, caused by a discharge in a previous sub-field 1 before the sub-field 8, a wall charge builds up on the dielectric layers in the picture cell 31. A building-up state of the wall charge changes based on whether the picture cell 31 is lit up or not in the previous sub-field 1. The primary discharge period 7 initializes the wall charge and generates a priming effect for making a charge easily when data is linear-sequentially written based on display data in following process.

The primary discharge period 7 includes a sustaining erasing period 2, a priming period 3 and a priming erasing period 4. In the sustaining erasing period 2, a discharge is generated in the display call 31 in which a sustaining discharge has been generated in the previous sub-field 1. The display call 31 in which the sustaining discharge is generated in the previous sub-field 1 is in a state of a wall charge arrangement as shown in FIG. 10A by a last sustaining pulse in the previous sub-field 1, namely, in a wall charge arrangement in which a negative wall charge 36 builds up over the scanning electrode 22 and on a surface of the transparent dielectric layer 24 (hereinafter, may be referred to as "over the scanning electrode S"), and positive wall charge 35 builds up over the common electrode 23 and on a surface of the transparent dielectric layer 24 (hereinafter, may be referred to as "over the common electrode C"), and over the data electrode 29 and on a surface of the white dielectric layer 28 (hereinafter, may be referred to as "over the data electrode D").

In this state, the previous sub-field 1 moves to the sustaining erasing period 2 in the primary discharge period 7. In the sustaining erasing period 2, the electric potential of the scanning electrode S and that of the data electrode D are set to the ground potential, and a positive electric potential Vs is applied to the common electrode C. With this operation, a potential difference between the scanning electrode S and the common electrode C becomes large gradually, and a weak discharge occurs between the scanning electrode S and the common electrode C. Then, as shown in FIG. 10B, a wall charge, close to the discharge gap 37, building up between the scanning electrode S and the common electrode C changes.

On the other hand, a wall charge arrangement in which no discharge occurs is accomplished in the display call 31 as shown in FIG. 10B before moving to the sustaining erasing period 2, and no discharge occurs during the sustaining erasing period 2. Therefore, at an end of the sustaining erasing period 2, each display call 31 is put in a state of wall charge arrangement as shown in FIG. 10B regardless of lighting up or not in the previous sub-field 1. In other words, each display call 31 is initialized.

In the priming period 3, a priming discharge is generated to generate a writing discharge at a low voltage in the scanning period 5 which will be described later, and the priming effect is obtained. As shown in FIG. 9, in the priming period 3, a positive ramp waveform increasing continuously from a predetermined positive electric potential to a specified voltage Vp in the scanning electrode S is applied and a ground potential is applied to the common electrode C and to the data electrode D. With this operation, a weak discharge is generated between the scanning electrode S and the common electrode C, a wall charge arrangement is accomplished in which wall charges are large at an edge portion on the scanning electrode S facing the common electrode C and at an edge over the common electrode C facing the scanning electrode S as shown in FIG. 10C.

Then, in the priming erasing period 4, while the ground potential is applied to the data electrode D, a voltage Vs is applied to the common electrode C. The electric potential of the scanning electrode S is continuously decreased from a predetermined electric potential. With this operation, a weak discharge occurs to return the wall charge building up in the priming period 3, and the wall charge arrangement is returned to a state as shown in FIG. 10D. Then, the primary discharge period 7 is finished.

In the scanning period 5, a positive voltage Vbw is applied to the scanning electrode S, and a positive voltage Vsw is applied to the common electrode C. Then, by sequentially setting electric potentials of the scanning electrode S1 to the scanning electrode Sm to the ground potential, a scanning pulse 9 is sequentially applied to the scanning electrode S1 to the scanning electrode Sm. A data pulse 10 is selectively applied to the data electrode D1 to the data electrode Dm so as to match with timing of the scanning pulse 9 based on the display data.

In a display call 31 where the data pulse 10 is applied to the data electrode D, a potential difference between the scanning electrode S and the data electrode D (hereinafter, maybe referred to as an opposition space) exceeds a firing voltage of the opposition space. Therefore, a writing discharge occurs in the opposition space, and a large positive wall charge builds up over the scanning electrode S. Also, with this discharge, in a space between the common electrode C and scanning electrode S (hereinafter, may be referred to as a surface space), the space to which the positive voltage Vsw is applied and is large biased to the positive electric potential, the charge moves, and a wall charge arrangement as shown in FIG. 10E is accomplished. In contrast with this, in a display call 31 where no data pulse 10 is applied, no writing discharge occurs, on the grounds that the potential difference across the opposition space does not achieve to the firing voltage, and therefore, there is no change in the wall charge arrangement. As described above, by the existence of the data pulse 9, two types of wall charge arrangements can be accomplished. Oblique lines of the data pulse 10 in FIG. 9 represent that existences of the data pulse 10 are changed by the display data. After applying the scanning pulse 9 to all of the scanning electrodes S (S1 to Sm), the sustaining period 6 starts. In the sustaining period 6, a sustaining pulse is alternately applied to all of the scanning electrodes S and to all of the common electrodes C. The voltage Vs of the sustaining pulse is set lower than the surface firing voltage. In a display call 31 where the writing discharge occurs, as shown in FIG. 10, since a positive wall charge builds up over the scanning electrode S and a negative wall charge builds up over the common electrode C, a wall voltage is generated in a surface space (between the scanning electrode S and the common electrode C). Therefore, when a first positive sustaining pulse (a first sustaining pulse) is applied to the scanning electrode S, the wall voltage is superimposed on the first positive sustaining pulse, the potential difference of the surface space becomes greater than the firing voltage, and the sustaining discharge occurs. With this sustaining discharge, a negative wall charge builds up over the scanning electrode S, and a positive wall charge build up over the common electrode C. When a second positive sustaining pulse (a second sustaining pulse) is applied to the common electrode C, the wall voltage is superimposed on the second positive sustaining pulse, and the sustaining discharge occurs again. As a result, when the first sustaining pulse generates, wall charges having reverse polarity are stored over the scanning electrode S and over the common electrode C. After this, by alternately applying the sustaining pulse to the scanning electrode S and the common electrode C, the sustaining discharge occurs contentiously by the same operation. In other words, a wall voltage caused by a wall charge building up through a x-th sustaining discharge is superimposed on a (xplus1)-th sustaining pulse, and the sustaining discharge is continued. A luminescence amount is determined by a number of times of sustaining discharges.

On the other hand, in a display call 31 where no writing discharge occurs in the scanning period 5, no wall charge is superimposed on the sustaining pulse. As described above, since only the sustaining pulse cannot achieve the firing voltage, no sustaining discharge occurs.

A group of the primary discharge period 7, the scanning period 5, and the sustaining period 6 is called the sub-field 8. When an image is displayed on the three electrode AC-type PDP, in one field to be a period for displaying image information for one display call 31, numbers of sustaining pulses in respective sub-fields are made different one another, it is selected whether each sub-field is lit up or not, and a number of sustaining discharges is controlled, thereby performing image gradation display.

However, the above-described method has the following problems. In the above-described conventional three-electrode AC-type PDP driving method, since a number of power sources for driving is decreased with possibility, setting voltages for respective pulses in the driving waveform are set commonly with possibility. Therefore, the common electrode potential in the sustaining erasing period 2 and the priming erasing period 4 is set to be equal to the sustaining voltage Vs. However, the sustaining voltage Vs is set lower than the surface firing voltage in each display call 31 of the three-electrode AC-type PDP. Therefore, the discharge is insufficient in the priming erasing period 4, and a size of the wall charge building up at the end portion of the scanning electrode S close to the common electrode C is not equal to a size of the wall charge building up at the end portion of the common electrode C close to the scanning electrode S. In other words, the wall charges, close to the discharge gap 37, building up between the common electrode C and the scanning electrode S are not equal.

As a result, in a display call 31 which is not lit up, an error discharge of the sustaining discharge is apt to generate. Therefore, it is impossible to set the sustaining voltage Vs at a high level. As a result, there are problems in that the discharge is still insufficient in the priming erasing period 4 and in that a driving margin (range) of the sustaining voltage Vs becomes limited and when the sustaining voltage Vs varies, the operation of the PDP becomes unstable.

Also, in the above-described conventional three-electrode AC-type PDP driving method, there is another problem in that the data pulse voltage is high such as 70V and a driving cost is high, thus requiring reduction of power consumption.

SUMMARY OF THE INVENTION

In view of the above, it is an object of the present invention to provide an AC-type plasma display panel having an extended driving margin (range) of the sustaining voltage and capable of being driven by a low voltage.

According to a first aspect of the present invention, there is provided a driving method for driving an AC (Alternating Current) type plasma display panel including: a first insulation substrate and a second insulation substrate arranged opposite to each other, a plurality of scanning electrodes and a plurality of common electrodes alternately formed on an surface of the first insulation substrate opposite to the second insulation substrate and extended in a first direction, a plurality of data electrodes formed on an face of the second insulation substrate opposed to the first insulation substrate and extended in a second direction perpendicular to the first direction, a first dielectric layer formed to cover the plurality of scanning electrodes and the plurality of common electrodes, a second dielectric layer formed to cover the plurality of data electrodes, a plurality of discharge gaps arranged between the scanning electrodes and the common electrodes, and a plurality of picture cells each of which includes one of cross points of the discharge gaps and data electrodes;

the driving method in which a field for displaying an image includes at least one sub-field including a primary discharge period for initializing a charge state in each of the picture cells and for generating a discharge easily, a scanning period for causing wall charges to build up in at least one picture cell selected based on display data, and a sustaining period for alternately applying voltages to the scanning electrodes and to the common electrodes so as to generate a sustaining discharge in the at least one picture cell having the wall charges, the driving method including:

a set-up step of making, in an end of the primary discharge period before a beginning of the scanning period, a wall voltage caused by a wall charge building up at an end portion close to the discharge gap in the scanning electrode region substantially equal to a wall voltage caused by a wall charge building up at an end portion close to the discharge gap in the common electrode region.

In the foregoing, a preferable mode is one wherein, in the set-up step in the end of the primary discharge period before the beginning of the scanning period, an electric potential difference between the scanning electrode and the common electrode is continuously increased, the electric potential difference is made substantially equal to a surface firing voltage being a minimum voltage for generating a discharge between the scanning electrode and the common electrode, and a weak discharge is generated between the scanning electrode and the common electrode, whereby the wall voltage due to the wall charge building up at the end close to the discharge gap in the scanning electrode region is made substantially equal to the wall voltage due to the wall charge building up at the end close to the discharge gap in the common electrode region.

Another preferable mode is one wherein, in the set-up step in the end of the primary discharge period before the beginning of the scanning period, an electric potential of the common electrode is set positive, and an electric potential of the scanning electrode is continuously decreased to a first electric potential lower than the electric potential of the common electrode by a voltage level corresponding to the surface firing voltage.

Still another mode is one wherein, in the set-up step in the end of the primary discharge period before the beginning of the scanning period, the positive electric potential applied to the common electrode is a constant electric potential.

Furthermore preferable mode is one wherein, in the set-up step in the end of the primary discharge period before the beginning of the scanning period, the first electric potential is set higher than the electric potential of the data electrode.

Still furthermore preferable mode is one wherein, in the set-up step in the end of the primary discharge period before the beginning of the scanning period, a difference between the first electric potential and the electric potential of the data electrode is set to 20 volts or less An additional preferable mode is one wherein, in the set-up step in the end of the primary discharge period before the beginning of the scanning period, the electric potential of the data electrode is set to a ground potential.

Still additional preferable mode is one wherein the primary discharge period includes a sustaining erasing period for initializing a charge state in each of the picture cells, a priming period for generating a priming discharge between the scanning electrode and the common electrode and a priming erasing period for erasing a wall charge caused by the priming discharge, and the set up step is performed during the priming erasing period.

Also, still another preferable mode is one that wherein further includes: a step, in the sustaining erasing period, of grounding the data electrode, of applying a second electric potential being positive to an electrode having a higher potential at a last sustain pulse in a previous sub-field in the scanning electrode or the common electrode and of applying a third electric potential higher than the second electric potential and in which a voltage between the second electric potential and the third electric potential is lower than the surface firing voltage to an electrode having a lower electric potential, and a step of grounding the data electrode and of decreasing continuously and grounding the electric potential of the electrode having lower electric potential from the third electric potential, while applying the second electric potential to the electrode having higher electric potential Still another preferable mode is one that wherein further includes: a step, in the priming period, of applying a positive electric potential continuously increasing to the scanning electrode and of generating a priming discharge by grounding the common electrode and the data electrode.

Still furthermore preferable mode is one wherein, during the scanning period, a scanning pulse lowering from a positive electric potential to a ground potential to the scanning electrode is sequentially applied to the scanning electrode, and a positive electric potential pulse is applied to the data electrode synchronously with the scanning pulse based on the display data, whereby a writing discharge is selectively generated between the scanning electrode region and the data electrode region so as to cause the wall charge to build up in the selected at least one picture cell.

With the above configurations, by making a wall voltage caused by a wall charge building up at an end portion of a side close to the common electrode in the scanning electrode region in the picture cell substantially equal to a wall voltage caused by a wall charge building up at an end portion of a side close to the scanning electrode in the common electrode region, an error discharge hardly generates during the sustaining period. As a result, the sustaining voltage can be increased, and the driving margin (range) of the sustaining voltage can be made wide. Also, the discharge during the priming erasing period can be sufficiently generated.

Also, wall voltages can be made equal easily. In addition, the weak discharge is a phenomenon where a weak discharge is kept, while the voltage of the discharge gap is kept at the firing voltage.

Furthermore, a high negative wall voltage can be left at an end portion of the surface discharge gap side in the scanning electrode region.

As a result, it is possible to reduce the data pulse voltage when writing.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes for carrying out the present invention will be described in further detail using embodiments with reference to the accompanying drawings.

First Embodiment

Figure 7:
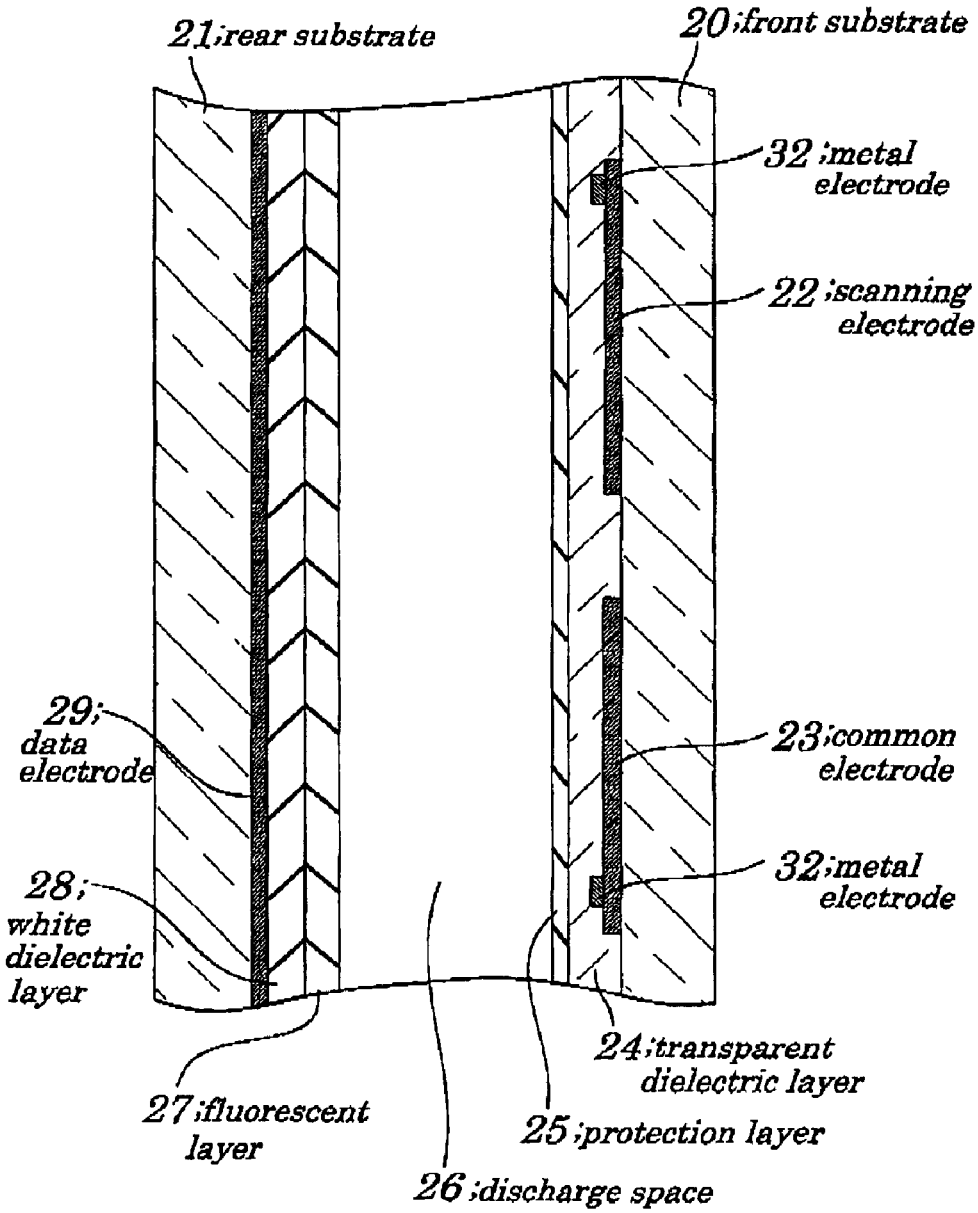
FIG. 7 (PRIOR ART)
FIG. 7 is a sectional view showing a picture cell structure of a conventional three-electrode AC-type POP driving method.
Figure 8:
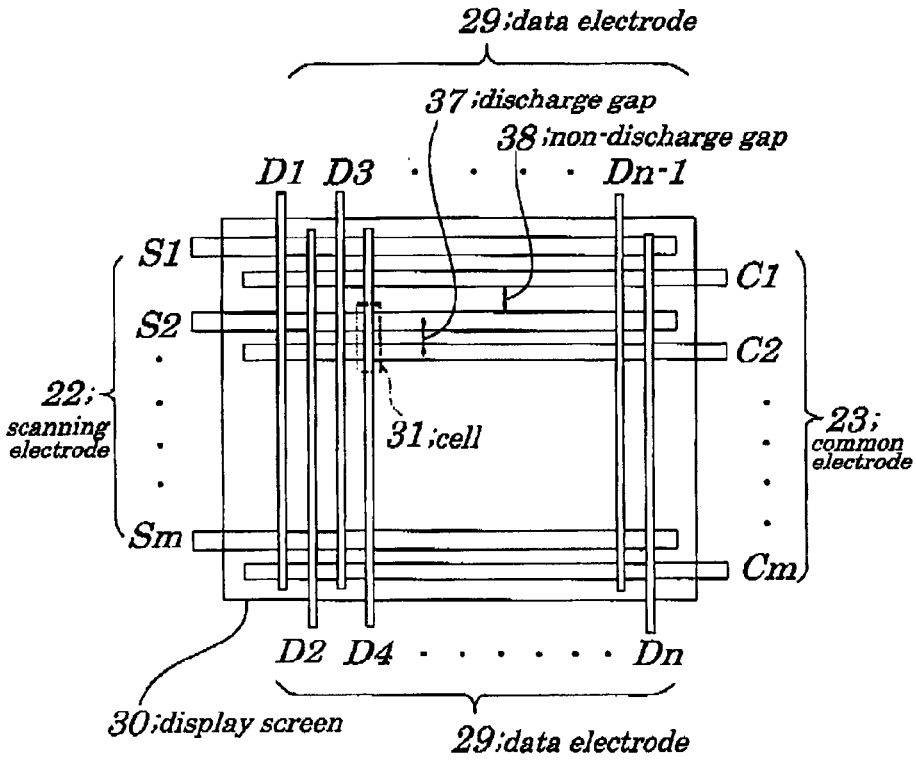
FIG. 8 (PRIOR ART)
FIG. 8 is a plan view showing an electrode arrangement of the conventional three-electrode AC-type PDP driving method.

A structure of an AC-type plasma display panel (PDP) according to a first embodiment of the present invention is similar to that of the conventional PDP shown in FIG. 7 and FIG. 8. A picture cell of the first embodiment is designed, for example, in a manner that a surface firing voltage between on a scanning electrode S and on a common electrode C is set to approximately 190V and the opposition firing voltage between the scanning electrode S or the common electrode C and a data electrode D is set to approximately 190V. For such a state, for example, a surface discharge gap is set to approximately 100 $\mu$m and an opposition discharge gap is set to approximately 120 $\mu$m. A vertical dimension of one picture cell is 0.81 mm and a horizontal dimension is 0.27 mm.

Figure 1:
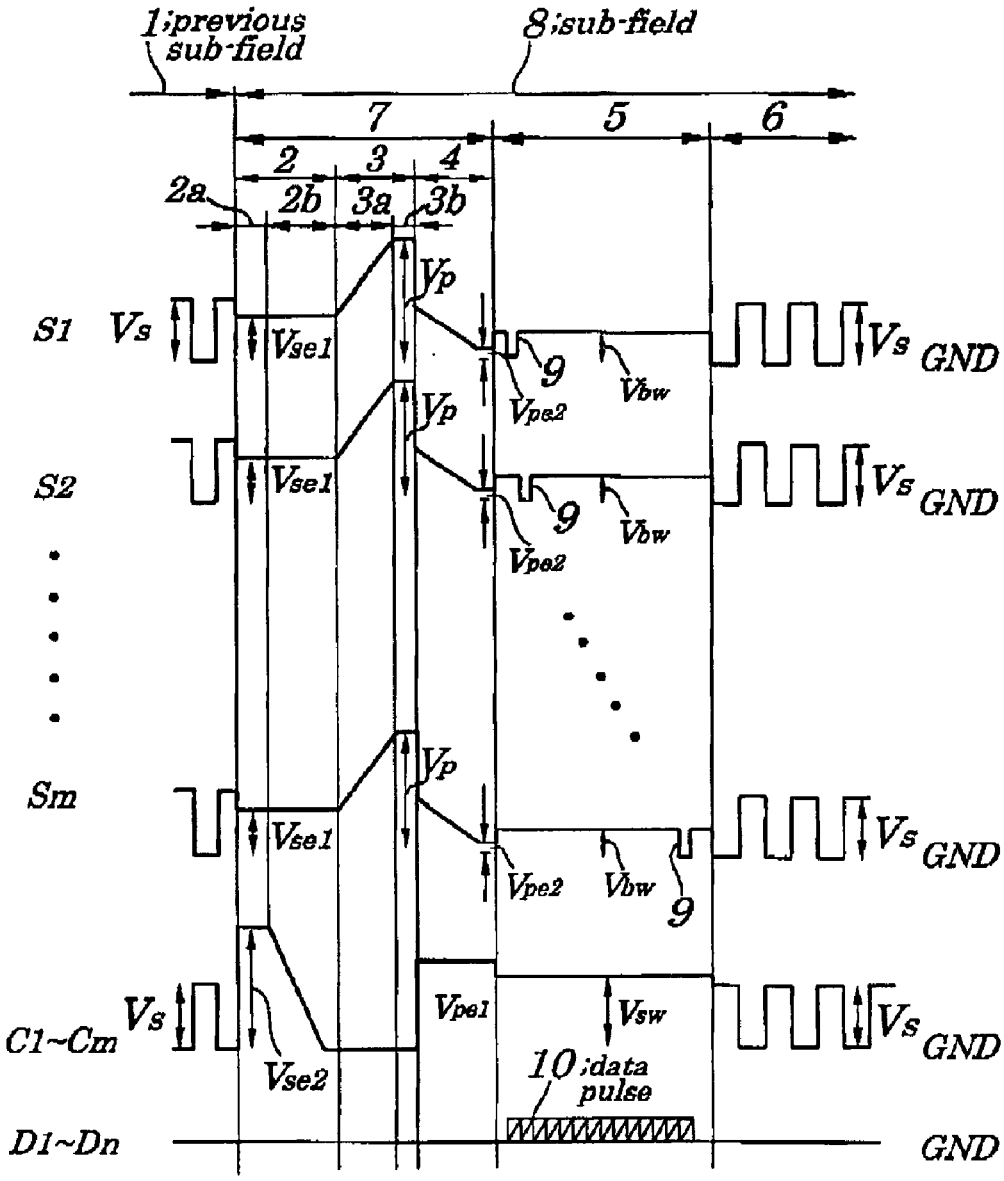
FIG. 1 shows a series of waveforms showing a PDP driving method according to a first embodiment of the present invention.

Next, a PDP driving method of the first embodiment will be explained. FIG. 1 shows a series of waveforms showing a PDP driving method according to the first embodiment, and FIG. 2A to FIG. 2E are sectional schematic views showing the PDP driving method according to the first embodiment. In FIG. 2A to FIG. 2E, wall charges are represented as positive wall charges 35 and a negative wall charges 36 by various polygonal figures, and heights of the positive wall charges 35 and the negative wall charges 36 represent levels of wall voltages being potential differences caused in dielectric layers by wall charges. Also, the scanning electrode S, the common electrode C, and the data electrode D are provided.

As shown in FIG. 1, in the PDP driving method of the first embodiment, a field includes a plurality of sub-fields, a previous sub-field 1 and a subfield 8, and one sub-field 8 includes three periods, namely, a primary period 7, a scanning period 5, and a sustaining period 6. The primary period 7 includes a sustaining erasing period 2, a priming period 3, and a priming erasing period 4.

Figure 2A:
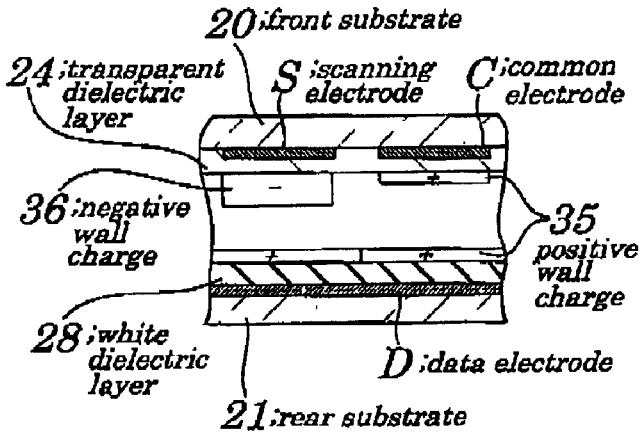
FIG. 2A to FIG. 2E are sectional schematic views showing the PDP driving method according to the first embodiment of the present invention.

A wall charge arrangement of the picture cell at an end of the previous sub-field 1 before the sub-field 8 is different based on whether the picture cell is lit up or not in the previous sub-field 1. When the picture cell is lit up, namely, when a sustaining discharge occurs, it is considered that a state shown in FIG. 2A is attained. A negative wall charge 36 builds up over the scanning electrode S on a surface of the transparent dielectric layer 24, the positive wall charges 35 builds up over the common electrode C on the surface of a transparent dielectric layer 24 and the negative wall charge 36 builds up over the data electrode D on a surface of a white dielectric layer 28. When a sustaining pulse Vs applied to the scanning electrode S and the common electrode C in the previous sub-field 1 is set to approximately 170V, a total of wall voltages generated over the scanning electrode S and over the common electrode C becomes Vs, namely, to approximately 170V.

Figure 2B:
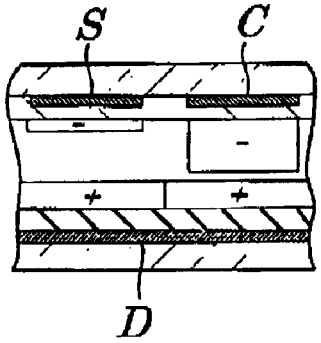
Figure 2D:
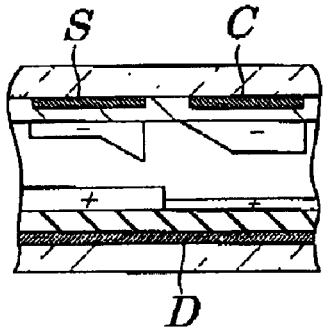
Figure 2C:
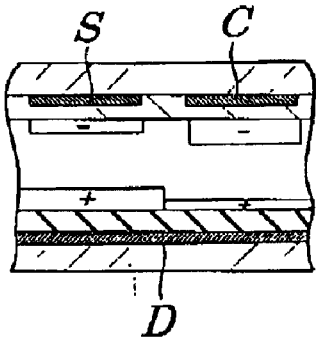
Figure 2E:
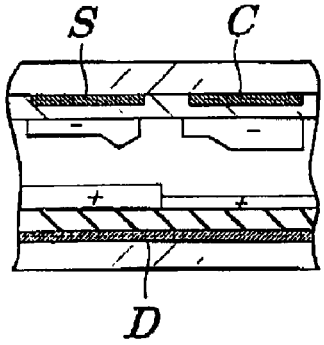

On the other hand, when the picture cell is not lit up in the previous sub-field 1, the wall charge arrangement at the end of the primary discharge period 7 in the previous sub-field 1 is kept, and therefore, a wall charge arrangement shown in FIG. 2E, namely, a wall charge arrangement is made in which negative wall charge 36 builds up over the scanning electrode S and the common electrode C, the negative wall charge 36 building up over the common electrode C is greater than the negative wall charge 36 building up over the scanning electrode S, the positive wall charge 35 builds up over the data electrode D, and over the data electrode D, the positive wall charge 35 building up in an area opposite to the scanning electrode S is greater than the positive wall charge 35 building up in an area opposite to the common electrode C.

In this state, the previous sub-field 1 moves to the sustaining erasing period 2 in the sub-field 8. The sustaining erasing period 2 includes a rectangular waveform period 2*a* and a ramp waveform period 2*b* following the rectangular waveform period 2*a*. During the rectangular waveform period 2*a*, a constant voltage Vse1 is applied to a scanning electrode S1 to a scanning electrode Sm. Also, a voltage Vse2 is applied to a common electrode C1 to a common electrode Cm. A data electrode D1 through a data electrode Dn are set to a ground potential. For example, the voltage Vse1 is set to 160 V and the voltage Vse2 is set to 280 V.

In a picture cell being lit up in the previous sub-field 1, as a voltage difference between the scanning electrode S and the common electrode C, an approximate 290 V in total is applied to the surface display gap since 170 V of a wall voltage is superimposed on Vse2 minus Vse1 equals 120 V. Since the surface firing voltage is 190 V, a surface discharge occurs between the scanning electrode S and the common electrode C. Also, at the same time, a wall voltage close to the voltage Vse2 is caused in total by a discharge between the scanning electrode S and the data electrode D. With this operation, a wall discharge arrangement shown in FIG. 2B is made.

In a picture cell being not lit up in the previous sub-field 1, as shown in FIG. 2E, since negative wall charges 36 being almost similar each other build up over the scanning electrode S and over the common electrode C, as the voltage deference, only Vse2 minus Vse1 equals 120 V is applied. This voltage (120 V) is lower than the surface firing voltage (190 V), and therefore, no discharge occurs in the picture cell.

In the ramp waveform period 2*b*, while sustaining the electric potentials of the scanning electrode S and the data electrode D, an electric potential to be applied to the common electrode C is continuously decreased from the voltage Vse2 to the ground potential. In the picture cell being lit up in the previous sub-field 1, a wall voltage of approximately 280 V is generated between the scanning electrode C and the data electrode D. Therefore, as the electric potential of the common electrode C is decreased, an opposite weak discharge occurs between the common electrode C and the data electrode D, and the negative wall voltage over the common electrode C and the positive wall voltage in an area opposite to the common electrode C over the data electrode D both decrease. With this operation, at the end of the sustaining erasing period 2, a wall charge arrangement as shown in FIG. 2C is accomplished.

The priming period 3 includes a ramp waveform period 3*a* and a rectangular waveform period 3*b* following the ramp waveform period 3*a*. During the ramp waveform period 3*a*, a ramp waveform voltage continuously increasing from the voltage Vse1 to a voltage Vp higher than the voltage Vse1 is applied to the scanning electrode S. The voltage Vp is set to, for example, 360 V to 400 V. The common electrode C and the data electrode D are set to the ground potential. Since the ramp waveform voltage is applied to the scanning electrode S, a weak discharge occurs mainly in the surface electrode space (between the scanning electrode S and the common electrode C). With this weak discharge, a state of the wall charge close to the surface discharge gap varies, and a wall charge arrangement shown in FIG. 2D is accomplished. After that, during the rectangular waveform period 3*b*, while keeping the common electrode C and the data electrode D at the ground potential, the voltage Vp is continuously applied to the scanning electrode S.

In the priming erasing period 4, contrary to the priming period 3, a ramp waveform voltage decreasing the electric potential of the scanning electrode S so as to be lower than the common electrode C is applied to the scanning electrode S. In other words, a voltage Vpe1 is applied to the common electrode C. Then, the electric potential of the scanning electrode S is discontinuously decreased so as to be lower than the voltage Vpe1, and then the electric potential is continuously decreased to a voltage Vpe2. With this operation, a surface weak discharge occurs in a manner that the wall charge, close to the surface discharge gap, building up during the priming period 3 decreases during the priming erasing period 4. Also, the electric potential of the data electrode D is set to the ground potential.

By making the electric potential of the scanning electrode S higher than the electric potential of the data electrode D in the priming erasing period 4, as shown in FIG. 2E, a negative wall voltage can be left at the end portion (side edge) of the surface discharge gap on of the scanning electrode S, so as to be higher than the negative wall voltage of the other portion. On the grounds of this negative wall voltage, it is possible to reduce the data pulse voltage when writing. However, when the negative wall voltage is too high, an erroneously writing discharge occurs in the scanning period 5, and therefore, erroneous firing generates in the sustaining period 6. In the first embodiment, when the voltage Vpe2 is set to 20 V or more, there is a fear that erroneous firing generates, and therefore, the voltage Vpe2 is set to 20 V.

Also, in order to make an error discharge difficult to generate during the sustaining period 6, the wall voltage over the scanning electrode S and the wall voltage over the common electrode C close to the surface discharge gap had better to be made as equal as possible. A weak discharge is a phenomenon in which a weak discharge continues while keeping the voltage in the surface discharge gap at the firing voltage. In a case of generating a weak discharge between two electrodes (the scanning electrode S and the common electrode C), when a total of a potential difference applied between the electrodes and the wall voltage caused by the wall charge exceeds the firing voltage, a wall charge for an over-voltage moves from "over one of two electrodes" to "over another of two electrodes". Therefore, the potential difference between the electrodes is continuously increased and becomes equal to the firing voltage at the end of the weak discharge, thereby making the potential difference due to the wall voltages to zero and making the wall voltages of various positions adjacent to the discharge gap almost equal to each other. In the first embodiment, since the surface firing voltage is 190 V by a picture cell characteristic, Vpe1 equals Vpe2 plus 190 V equals 210 V. With this operation, as shown in FIG. 2E, the wall charges close to the surface discharge gap become approximately equal. Further, as shown in FIG. 2C, since the negative wall charges 36 build up over the scanning electrode S and over the common electrode C immediately before the priming period 3, the negative wall charge 36 having a peak over the scanning electrode S can be formed easily. With this operation, the data pulse voltage at writing can be lowered.

Figure 9:
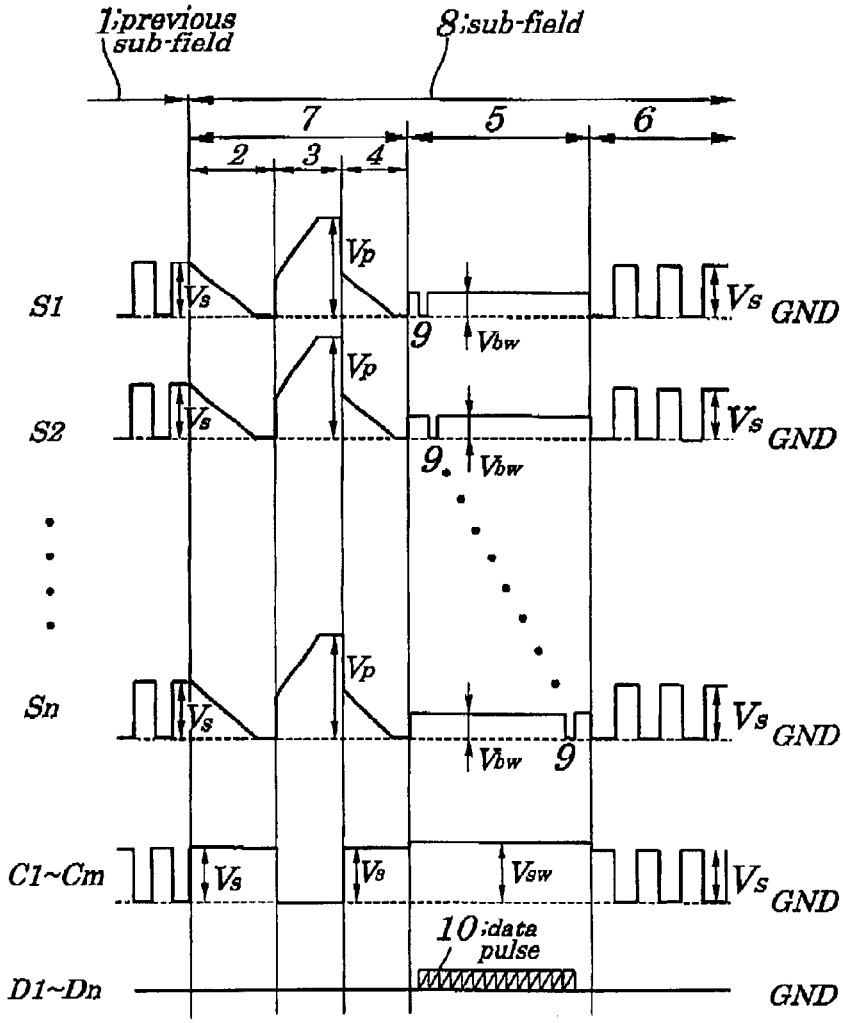
FIG.9 (PRIOR ART)
FIG. 9 shows a series of waveforms showing the conventional three-electrode AC-type PDP driving method.

The driving method during the scanning period 5 is similar to that of the conventional driving method shown in FIG. 9. In other words, a scanning pulse 9 is linear-sequentially applied to the scanning electrode S1 to the scanning electrode Sm. The scanning pulse 9 is applied by applying the ground potential in pulses by using a positive potential Vbw as a reference. Then, based on the display data, a data pulse 10 is applied to the data electrode D at timing similar to the scanning pulse 9. With this operation, in a picture cell where the data pulse 10 is applied to the data electrode D, a total voltage of the scanning pulse 9 and the data pulse 10 exceeds the opposition firing voltage, and a writing discharge occurs.

Figure 10A:
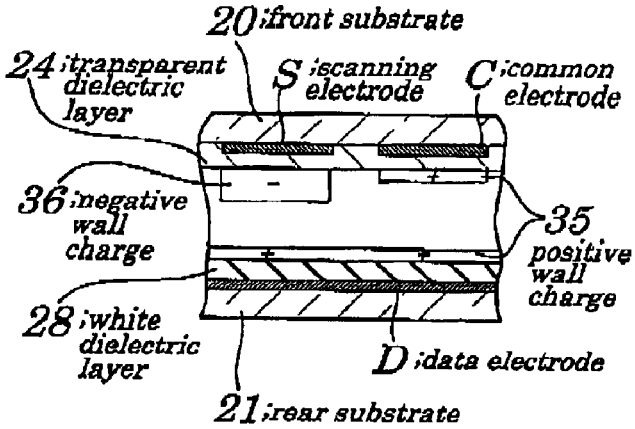
FIG. 10A (PRIOR ART)
FIG. 10A to FIG. 10E are sectional schematic views showing a conventional PDP driving method.
Figure 10B:
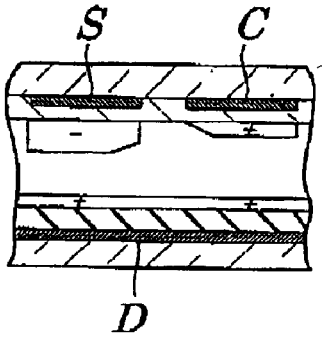
FIG. 10B (PRIOR ART)
Figure 10C:
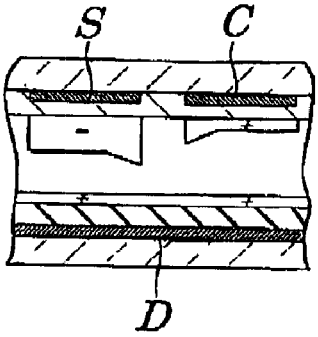
FIG. 10C (PRIOR ART)
Figure 10D:
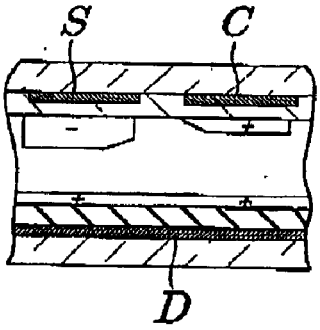
FIG. 10D (PRIOR ART)
Figure 10E:
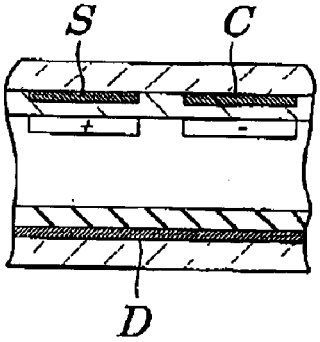
FIG. 10E (PRIOR ART)

In the conventional driving method, as shown in FIG. 10D, before generating the writing discharge, the positive wall charge 35 build up over the common electrode C, and, as shown in FIG. 10E, the negative wall charge 36 builds up over the common electrode C. However, in the first embodiment, as shown in FIG. 2E, before generating the writing discharge, the negative wall charge 36 builds up already over the common electrode C, and therefore, almost no charge moves in the surface discharge gap.

The driving method during the sustaining period 6 is similar to that of the conventional driving method shown in FIG. 9. In other words, the sustaining voltage Vs is applied to the scanning electrode S and the common electrode C alternately. The data electrode D is set to the ground potential. With this operation, the sustaining discharge occurs only in a picture cell where writing discharge occurs during the scanning period 5, and the picture cell is lit up. With this operation, it is possible to control to light up or not. Moreover, in the first embodiment, a width of the ramp waveform is set to 40 μsec. to 80 μsec.

According to the first embodiment, the weak discharge is generated between the scanning electrode S and the common electrode C by applying the ramp waveform voltage to the scanning electrode S, and the potential difference at the end of the weak discharge becomes equal to the firing voltage, thereby making the wall charges close to the surface discharge gap equal. With this operation, an error discharge is difficult to generate in the sustaining period 6, and the sustaining voltage Vs can be increased.

Also, according to the first embodiment, by making the electric potential of the scanning electrode S during the priming erasing period 4 higher than the electric potential of the data electrode D, the high negative wall voltage can be remained at the end portion of the surface discharge gap side over the scanning electrode S. With this negative wall voltage, the data pulse voltage at writing can be reduced.

Second Embodiment

Figure 3:
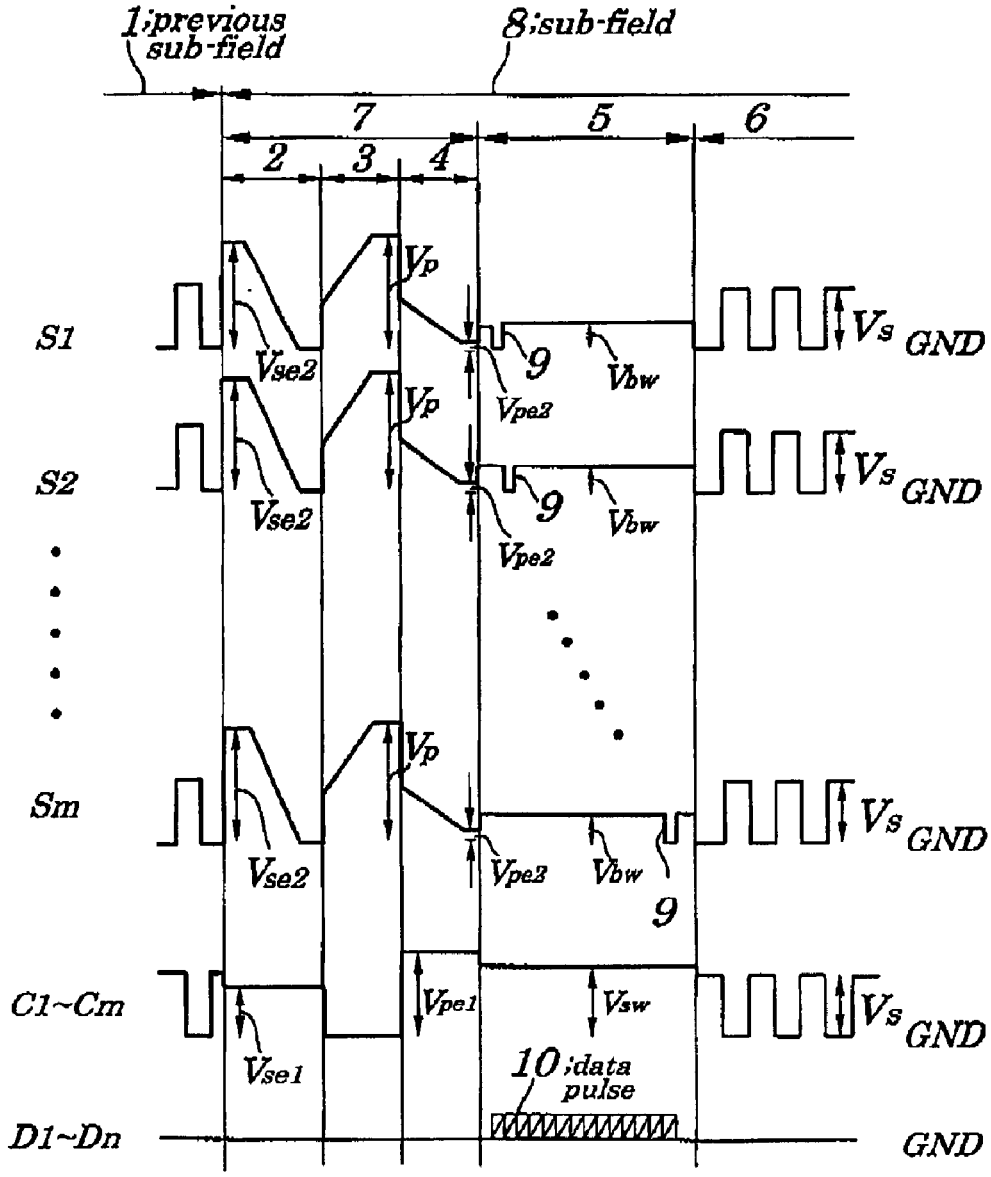
FIG. 3 shows a series of waveforms showing a PDP driving method according to a second embodiment of the present invention.

A structure of an AC-type plasma display panel (PDP) according to a second embodiment of the present invention is similar to that of the above-described AC-type PDP according to the first embodiment. FIG. 3 shows a series of waveforms showing a PDP driving method according to the second embodiment, and FIG. 4A to FIG. 4E are sectional schematic views showing the PDP driving method according to the second embodiment. In a comparison of the driving method according to the second embodiment and that according to the first embodiment, a polarity of a final sustaining pulse during a sustaining period 6 is inverted. In other words, in the above-descried first embodiment, an electric potential of a scanning electrode S is higher than that of a common electrode C, however, in the second embodiment, an electric potential of the scanning electrode S is lower than that of the common electrode C.

Therefore, in the second embodiment, the driving waveform to be applied to the scanning electrode S and the common electrode C during a sustaining erasing period 2 is reverse of that in the first embodiment. In other words, first, the electric potential of the scanning electrode S is set to a voltage Vse2 and then is continuously decreased to a ground potential. Also, a voltage Vse1 is applied to the common electrode C. With this operation, wall charge arrangements during the sustaining erasing period 2 shown in FIG. 4A to FIG. 4C in the second embodiment are similar to those where the scanning electrode S and the common electrode C are changed each other shown in FIG. 2A to FIG. 2C.

Figure 4A:
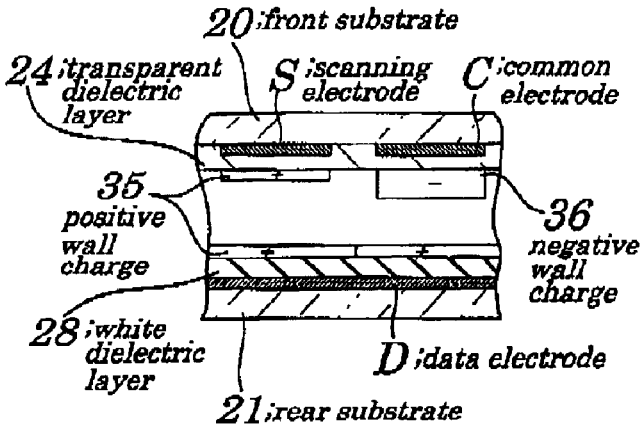
FIG. 4A to FIG. 4E are sectional schematic views showing the PDP driving method according to the second embodiment of the present invention.
Figure 4B:
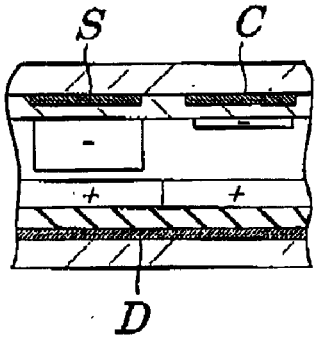
Figure 4D:
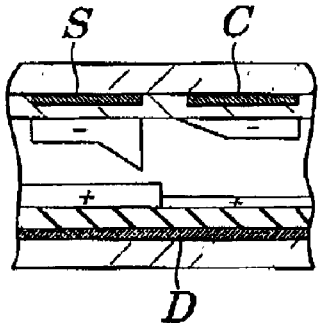
Figure 4C:
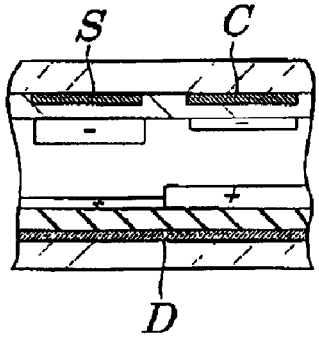
Figure 4E:
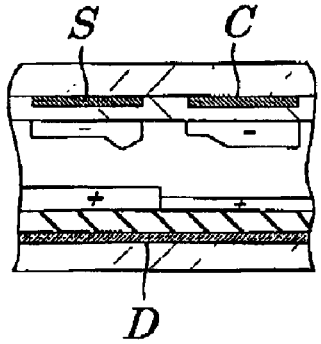

The driving method according to the second embodiment except the above-described operations is similar to the driving method according to the first embodiment. With this operation, a wall charge arrangement at the end of a priming period 3 is shown in FIG. 4D, and the wall charge arrangement at the end of a priming erasing period 4 is shown in FIG. 4E.

EXAMPLES

Figure 5:
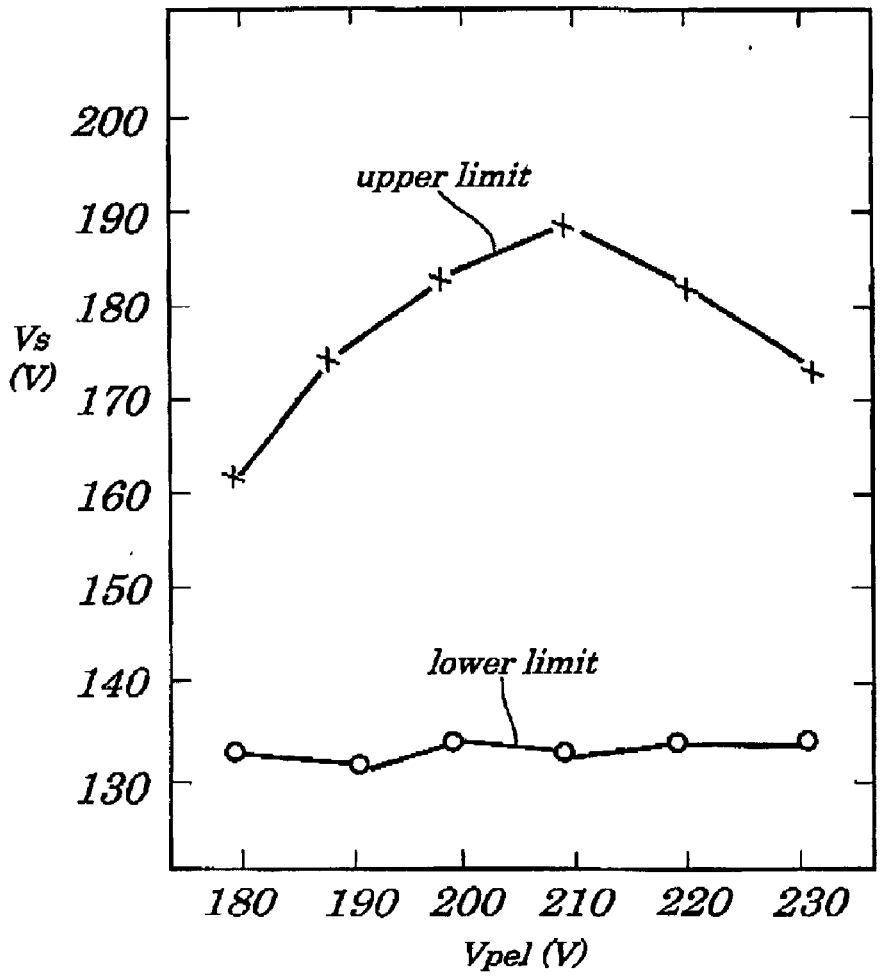
FIG. 5 is a graph showing dependence of an upper limit value and a lower limit value of a sustaining voltage Vs on a voltage Vpe1 when an axis of the abscissas represents the voltage Vpe1 and an axis of the ordinate represents the upper limit value and the lower limit value of the sustaining voltage Vs.
Figure 6:
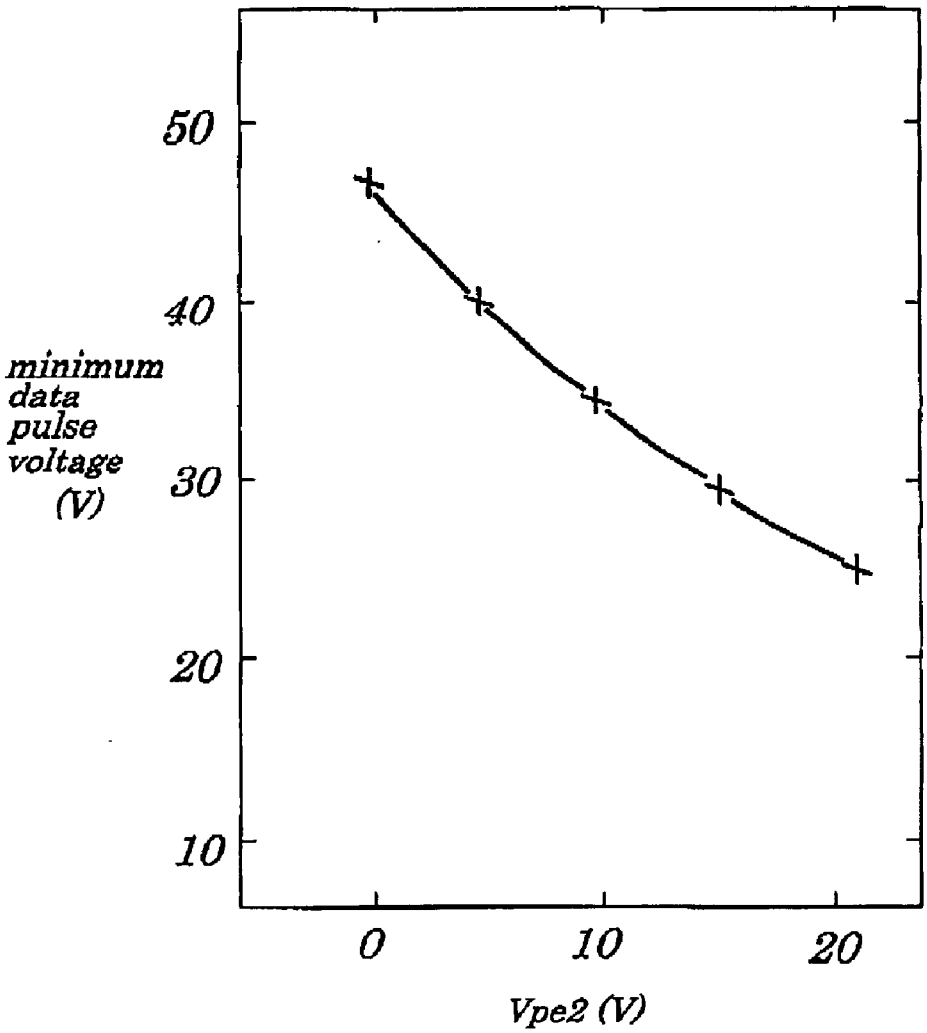
FIG. 6 is a graph showing dependence of a voltage on Vpe2 on a minimum data pulse voltage when an axis of the abscissas represents the voltage Vpe2 and an axis of the ordinate represents the minimum data pulse.

Effects of the first embodiment and the second embodiment according to the present invention will be concretely explained. A PDP driving method according to the first embodiment (refer to FIG. 1) was executed, and dependence of an upper limit value and a lower limit value of a sustaining voltage on a voltage Vpe1 and dependence of a minimum data pulse on a voltage Vpe2 were investigated. The upper limit value and the lower limit value of the sustaining voltage are an upper limit value and a lower limit value of the sustaining voltage when a PDP operates normally. Also, a minimum data pulse voltage is a minimum data pulse voltage for normally lighting a picture cell to which a data pulse is applied at writing. FIG. 5 is a graph showing dependence of the upper limit value and the lower limit value of the sustaining voltage Vs on a voltage Vpe1 when the axis of the abscissas represents the voltage Vpe1 and the axis of the ordinate represents the upper limit value and the lower limit value of the sustaining voltage Vs. Also, the voltage Vpe1 was set to 20 V. FIG. 6 is a graph showing dependence of a voltage on the voltage Vpe2 on a minimum data pulse voltage when the axis of the abscissas represents the voltage Vpe2 and the axis of the ordinate represents the minimum data pulse. Also, the voltage Vpe1 was set to be Vpe1 equals 190 plus Vpe2 (V).

As shown in FIG. 5, by setting the voltage Vpe1 set to approximate 210 V (equalsfiring voltage (190 V) plus Vpe2 (20 V)) the upper limit value of the sustaining voltage could be set at a highest value. Conventionally, the upper limit value of the sustaining voltage was approximately 175 V, however, in the first embodiment, the upper limit value of the sustaining voltage was improved to approximately 190 V. Also, though the voltage Vpe1 was varied, the lower limit value of the sustaining voltage hardly changed. Therefore, by setting the voltage Vpe1 to approximately 210 V, a driving margin (range) of the sustaining voltage could be made wide.

As shown in FIG. 6, conventionally, the data pulse voltage required approximately 48 V, however, by setting the voltage Vpe2 equals 20 V, the data pulse voltage could be reduced to approximately 25 V.

What is claimed is:

1. A driving method for driving an alternating current plasma display panel comprising: a first insulation substrate and a second insulation substrate arranged opposite to each other, a plurality of scanning electrodes and a plurality of common electrodes alternately formed on an surface of said first insulation substrate opposite to said second insulation substrate and extended in a first direction, a plurality of data electrodes formed on an face of said second insulation substrate opposed to said first insulation substrate and extended in a second direction perpendicular to said first direction, a first dielectric layer formed to cover said plurality of scanning electrodes and said plurality of common electrodes, a second dielectric layer formed to cover said plurality of data electrodes, a plurality of discharge gaps arranged between said scanning electrodes and said common electrodes, and a plurality of picture cells each of which includes one of cross points of said discharge gaps and data electrodes;

said driving method in which a field for displaying an image includes at least one sub-field including a primary discharge period for initializing a charge state in each of said picture cells and for generating a discharge easily, a scanning period for causing wall charges to build up in at least one picture cell selected based on display data, and a sustaining period for alternately applying voltages to said scanning electrodes and to said common electrodes so as to generate a sustaining discharge in said at least one picture cell having said wall charges, said driving method comprising:

a set-up step of making, in an end of said primary discharge period before a beginning of said scanning period, a wall voltage caused by a wall charge building up at an end portion close to said discharge gap in said scanning electrode region substantially equal to a wall voltage caused by a wall charge building up at an end portion close to said discharge gap in said common electrode region.

2. The driving method for driving the alternating current plasma display panel according to claim 1: wherein, in said set-up step in said end of said primary discharge period before said beginning of said scanning period, an electric potential difference between said scanning electrode and said common electrode is continuously increased, said electric potential difference is made substantially equal to a surface firing voltage being a minimum voltage for generating a discharge between said scanning electrode and said common electrode, and a weak discharge is generated between said scanning electrode and said common electrode, whereby said wall voltage due to said wall charge building up at said end close to said discharge gap in said scanning electrode region is made substantially equal to said wall voltage due to said wall charge building up at said end close to said discharge gap in said common electrode region.

3. The driving method for driving the alternating current plasma display panel according to claim 2: wherein, in said set-up step in said end of said primary discharge period before said beginning of said scanning period, an electric potential of said common electrode is set positive, and an electric potential of said scanning electrode is continuously decreased to a first electric potential lower than said electric potential of said common electrode by a voltage level corresponding to said surface firing voltage.

4. The driving method for driving the alternating current plasma display panel according to claim 3: wherein, in said set-up step in said end of said primary discharge period before said beginning of said scanning period, said positive electric potential applied to said common electrode is a constant electric potential.

5. The driving method for driving the alternating current plasma display panel according to claim 3: wherein, in said set-up step in said end of said primary discharge period before said beginning of said scanning period, said first electric potential is set higher than said electric potential of said data electrode.

6. The driving method for driving the alternating current plasma display panel according to claim 5: wherein, in said set-up step in said end of said primary discharge period before said beginning of said scanning period, a difference between said first electric potential and said electric potential of said data electrode is set to 20 volts or less.

7. The driving method for driving the alternating current plasma display panel according to claim 5: wherein, in said set-up step in said end of said primary discharge period before said beginning of said scanning period, said electric potential of said data electrode is set to a ground potential.

8. The driving method for driving the alternating current plasma display panel according to claim 2: wherein said primary discharge period includes a sustaining erasing period for initializing a charge state in each of said picture cells, a priming period for generating a priming discharge between said scanning electrode and said common electrode and a priming erasing period for erasing a wall charge caused by said priming discharge, and said set up step is performed during said priming erasing period.

9. The driving method for driving the alternating current plasma display panel according to claim 8, further comprising: a step, in said sustaining erasing period, of grounding said data electrode, of applying a second electric potential being positive to an electrode having a higher potential at a last sustain pulse in a previous sub-field in said scanning electrode or said common electrode and of applying a third electric potential higher than said second electric potential and in which a voltage between said second electric potential and said third electric potential is lower than said surface firing voltage to an electrode having a lower electric potential, and a step of grounding said data electrode and of decreasing continuously and grounding said electric potential of said electrode having lower electric potential from said third electric potential, while applying said second electric potential to said electrode having higher electric potential.

10. The driving method for driving the alternating current plasma display panel according to claim 8, further comprising: a step, in said priming period, of applying a positive electric potential continuously increasing to said scanning electrode and of generating a priming discharge by grounding said common electrode and said data electrode.

11. The driving method for driving the alternating current plasma display panel according to claim 1: wherein, during said scanning period, a scanning pulse lowering from a positive electric potential to a ground potential to said scanning electrode is sequentially applied to said scanning electrode, and a positive electric potential pulse is applied to said data electrode synchronously with said scanning pulse based on said display data, whereby a writing discharge is selectively generated between said scanning electrode region and said data electrode region so as to cause said wall charge to build up in the selected at least one picture cell.

* * * * *